United States Patent [19]

Van Woensel

[11] Patent Number: 5,037,327

[45] Date of Patent: Aug. 6, 1991

[54] CONNECTOR WITH MEANS FOR SECURING TO A SUBSTRATE

[75] Inventor: Johannes Maria B. Van Woensel, Rosmalen, Netherlands

[73] Assignee: E. I. Du Pont de Nemours and Company, Wilmington, Del.

[21] Appl. No.: 640,564

[22] Filed: Jan. 14, 1991

Related U.S. Application Data

[63] Continuation of Ser. No. 502,881, Apr. 2, 1990, abandoned.

[30] Foreign Application Priority Data

Jan. 13, 1989 [NL] Netherlands ..... 8900796

[51] Int. Cl.[5] ..... H01R 13/73

[52] U.S. Cl. ..... 439/571

[58] Field of Search ..... 439/566, 567, 571, 572

[56] References Cited

U.S. PATENT DOCUMENTS

| | | | |
|---|---|---|---|
| 4,628,410 | 12/1986 | Goodman et al. | 439/83 |
| 4,691,971 | 9/1987 | Hahn | 439/78 |
| 4,695,106 | 9/1987 | Feldman et al. | 439/83 |
| 4,826,442 | 5/1989 | Douty et al. | 439/83 |
| 4,846,727 | 7/1989 | Glover et al. | 439/608 |
| 4,907,987 | 3/1990 | Douty et al. | 439/571 |

FOREIGN PATENT DOCUMENTS

| | | |
|---|---|---|
| 0147039 | 11/1984 | European Pat. Off. . |
| 1515850 | 1/1970 | Fed. Rep. of Germany . |

*Primary Examiner*—Gary F. Paumen

[57] ABSTRACT

A connector having means for securing the connector to a substrate. The securing means comprises at least one metal member which is accommodated in at least one of the walls of the housing of the connector. The metal member has a part projecting at right angles to a plane of the connector wall facing the substrate. The projecting part engages in a corresponding aperture of the substrate where the connector is secured to the substrate by, for example, soldering.

2 Claims, 2 Drawing Sheets

CONNECTOR WITH MEANS FOR SECURING TO A SUBSTRATE

This application is a continuation of application Ser. No. 07/502,881 filed Apr. 2, 1990, now abandoned.

BACKGROUND OF THE INVENTION

This invention relates to an electronic connector and in particular to means for retaining or securing an electronic connector to a substrate such as a printed circuit board.

Electronic connectors are generally provided with projections such as lips or lobes on the end faces of the insulating housing. The connector can then be secured to a circuit board substrate by means of, for example, a screwed or riveted joint in an aperture formed in these projections and in the substrate. Examples of prior art securing means are disclosed in U.S. Pat. Nos. 4,628,410, 4,691,971 and 4,695,106.

Electronic circuits are currently accommodated as far as possible in a modular manner on printed circuit boards of standard dimensions. Electrical connections between the individual modules and/or other electronic equipment are preferably achieved by means of connectors. Due to the need for miniaturization, and due to the relatively greater density of the integrated circuits today, a large number of electronic modules can be disposed on a printed circuit board. As a result, each such module can carry out a large number of functions. This means, however, that the number of electrical connections to other modules also increases.

In the effort to achieve the highest possible contact element density, i.e. the greatest possible number of contact elements per volume unit, the above-mentioned projections for securing the connector on a substrate constitute a limiting factor. The space taken up on a substrate by these projections cannot be used for fitting circuit elements or contact elements. These projections also make it impractical to fit several connectors of standard dimensions on a substrate end-to-end with their end boundary walls adjacent to each without losing one or more positions otherwise available for contact elements for the purpose of forming a connector of desired dimensions. In trade literature, this is also known as end-to-end stacking.

A more recent prior art connector described in U.S. Pat. No. 4,826,422 granted May 2, 1989 employs a solder clip with a projection or solder tail projecting from the bottom of the connector housing. The solder tail is inserted into a hole on a printed circuit board where it is soldered to secure the connector. The metal clip has a wide, flat base which must be inserted in a recessed channel in the bottom wall of the connector housing. There must, however, be sufficient space in the bottom wall to receive the flat plate of the solder clip.

SUMMARY OF THE INVENTION

The object of the invention is to provide a connector without projections or other space-taking securing or retaining means disposed on the end faces of the connector housing.

This is achieved according to the present invention by providing a securing means which includes at least one metal member which is accommodated in at least one of the walls of the housing, and which has a part projecting at right angles to the outward-facing plane of the bottom wall. This part engages in a corresponding aperture of the substrate when the connector is fitted for securing the connector to the substrate.

An advantage of the invention is that the area of the substrate already taken up by the bottom wall of the housing in any event is now being used effectively for connecting and securing the housing to the substrate. Since no securing elements project laterally from the housing, several connectors can now be stacked end-to-end on the substrate with their end faces abutting against each other. The end walls of the housing have a thickness less than or equal to half the distance between adjacent contact elements. As a result, connectors can be secured on a substrate without losing any positions otherwise available for contact elements. This permits the desired higher contact density to be achieved.

The present invention meets the required standard of sturdy retention on the substrate, particularly in the case of connectors with several contact elements arranged in rows and columns. This prevents undesirable forces from being exerted on the connections of the connecting ends of the contact elements to the substrate when such a connector is contacted.

A very advantageous embodiment of the connector according to the present invention facilitates assembly. The outward-projecting part of the metal member may be pin-shaped and connected by soldering to a metallized contact area on the substrate.

In automated assembly of a printed circuit board, the connector may be firmly secured on the substrate by means of this pin-shaped part of the metal member during the soldering process of the components, for example in a soldering bath and the like. The pin-shaped part is preferably accommodated in a "through-metallized" aperture or hole in the substrate and soldered into it. The above-mentioned contact area is in this case the inside wall of the relevant hole, coated or plated through with solderable material. The soldered joint also allows the connector to be replaced very simply in case of defect. This contrasts with connectors which are secured by means of adhesive on a printed circuit board, in which replacement is generally impossible and risks damaging the board.

Yet another embodiment of the invention provides that the metal member be accommodated in at least one of the end boundary walls of the housing. An advantage of this embodiment is the fact that forces directed at right angles to the end boundary faces of the housing can also effectively be absorbed with it.

In yet another embodiment of the invention provision is made for channels which are adjacent to each other in the lengthwise direction of the housing. The channels accommodate the contact elements and are separated from each other by partition walls. The metal members are accommodate in one or more of the partition walls.

When connectors are stacked end-to-end without loss of contact element positions in the substrate, the end boundary walls are of a thickness which is less than or equal to half the thickness of a partition wall. Depending on the desired pitch distance between the adjacent contact elements of a connector, the end boundary walls may be too thin to accommodate a metal member or may not be mechanically strong enough for this. In this case, it would then be preferable to accommodate the metal member in a partition wall of the connector.

It will be clear that several different metal members can be accommodated in one and the same connector, for example, in each of the end boundary walls or one or more partition walls, as described above.

The invention is explained in greater detail below with reference to the exemplary embodiments shown in the drawing.

DETAILED DESCRIPTION OF THE EMBODIMENT

Figure 1:
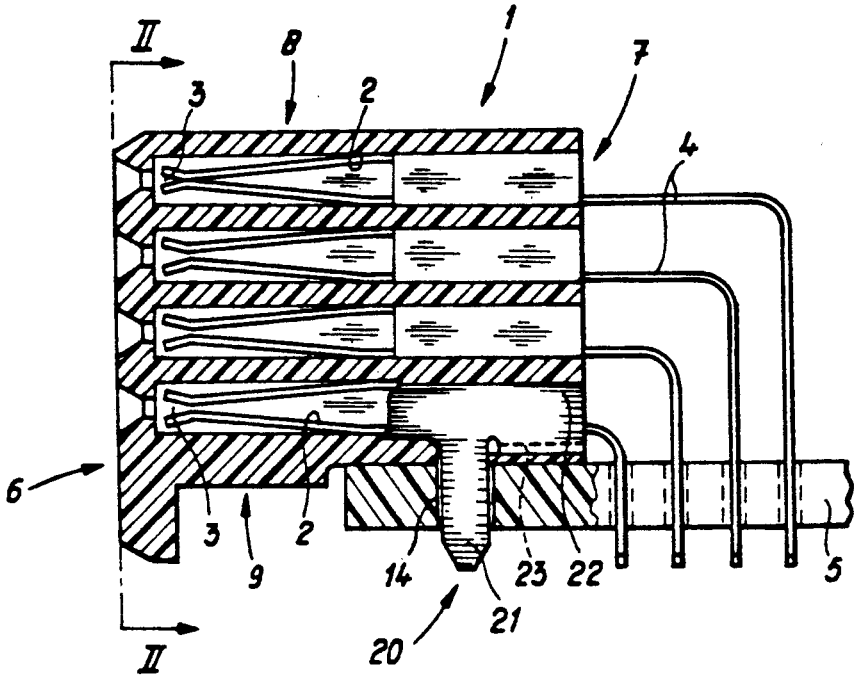
FIG. 1 shows schematically a cross section of an embodiment of a connector made according to the invention as secured on a substrate.
Figure 2:
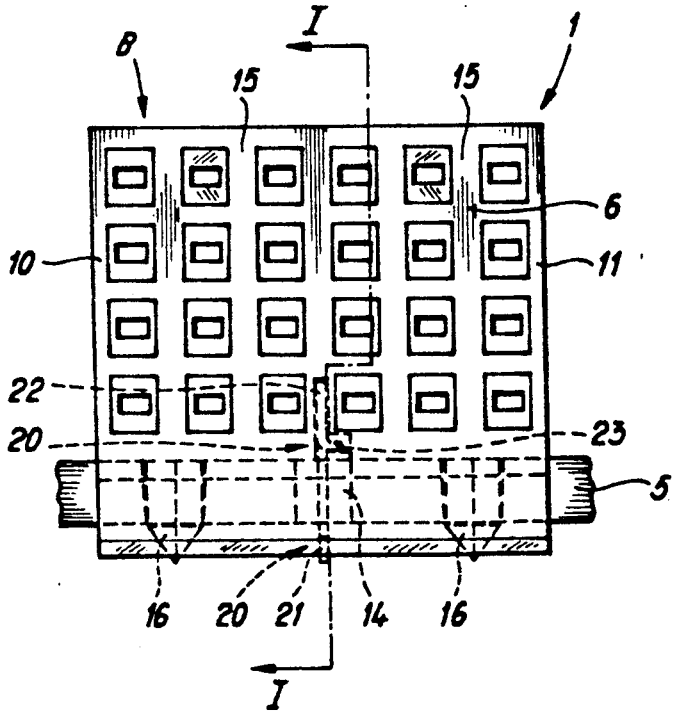
FIG. 2 shows schematically a front view of the connector of FIG. 1.

FIG. 1, which is a cross sectional view along the line I—I of FIG. 2, shows a preferred embodiment of a connector with securing means for fitting on a substrate according to the invention. The connector, which is indicated in its entirety by reference number 1, comprises a housing of electrically insulating material containing several contact elements 2 of electrically conducting material. In the embodiment shown, the contact elements 2 have a socket-type contact end 3 for receiving a mating connector, and connecting ends 4 for electrically connecting the contact elements 2 to the substrate 5, such as a printed circuit board, by means of pin-hole connections which are typical in circuit board assembly. Instead of the socket-type contact ends 3 shown, the contact elements 2 can also have contact ends designed as contact pins (not shown) for mating with another connector.

Figure 3:
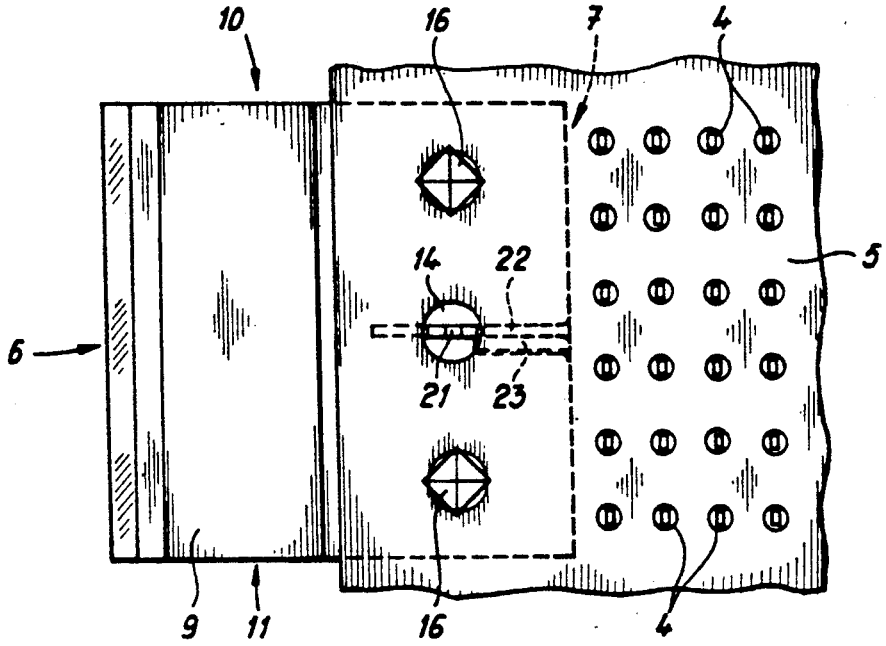
FIG. 3 shows schematically a bottom view of the connector of FIG. 1 secured on a substrate.

The housing of the connector 1, which is preferably made of plastic, has a front wall 6 from which the contact ends 3 are accessible, a rear wall 7 from which the connecting ends 4 of the contact elements 2 project outside the housing, a top wall 8 and a bottom wall 9, part of which projects beyond the edge of the substrate 5, while another part rests on the surface of the substrate 5. The boundary walls situated on the end faces of the housing are indicated by reference numbers 10, 11 in FIGS. 2 and 3, which show the front view from the line II—II in FIG. 1 and the bottom view of the connector according to FIG. 1 fitted on a substrate 5.

A part of the bottom wall 9 faces and rests on the surface of the substrate 5. A part 21 of a metal member 20 projects at right angles to the bottom wall, and is inserted in an aperture 14 of the substrate 5.

By placing a metallized contact area on the surface of the substrate 5 facing where the part 21 of metal member 20 projects, the connector I can be secured firmly on the substrate 5 by soldering the metal member 20 onto the metallized contact area. The metallized contact area can be similar to contact areas commonly placed on printed circuit boards for electrically connecting components to the board. It is preferably, however, to use a through-metallized aperture 14 whose inside wall is plated with solderable material.

As shown in FIGS. 1 and 2, the connector does not have nor does it need lateral lips or lobes for securing it to the substrate 5. By making the wall thickness of the end boundary walls 10, 11 half or less the material thickness of the vertical partition walls 15 situated between adjacent contact elements 2 (viewed in the plane of the drawing), connectors with the securing means according to the invention can advantageously be made end-to-end stackable. This means that extensive connector with a high contact element density can be assembled without loss of position of one or more contact elements.

In order effectively to absorb forces acting in the lengthwise or lateral direction of the connector 1 and to make the positioning of the connector easier, the connector 1 is provided with positioning lobes 16 which project perpendicular to the bottom face 9 and engage with corresponding apertures of the substrate.

Figure 4A:
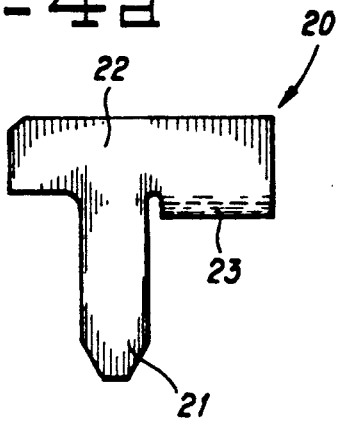
FIGS. 4*a* and 4*b* show schematically on an enlarged scale view of the metal member used in FIGS. 1–3 for securing the connector.
Figure 4B:
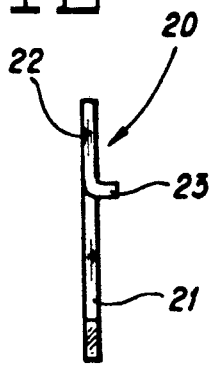

FIGS. 4*a* and 4*b* show the metal member 20 for securing the connector 1. The flat metal member 20 shown is approximately T-shaped. A pin-shaped part 21 thereof is used here to secure the connector to the substrate 5, while another part 22 extending at right angles to the part 21 is accommodated in a wall of the housing of the connector 1. As seen clearly in FIG. 2, the part 22 extends in a partition wall 15. Part 22 of the metal member 20 is also provided with a lip 23 projecting at right angles to the face thereof, and which may be accommodated in the bottom face 9 of the housing for engaging an interior surface thereof. The lip 23 effectively absorbs forces acting on the housing in the lengthwise direction of the pin-shaped part 21.

The thickness of the metal member 20 is selected so that it can be contained entirely within a partition wall 15. Although not shown, it will be clear that the metal member 20 can also be accommodated in one or both end boundary walls 10, 11. For the sake of the envisaged mechanical strength, it is preferable for the metal member 20 to be fitted in a partition wall. Of course, several metal members 20 can also be used for securing the connector in the housing thereof.

The embodiment shown uses a metal member 20 which preferable made from a sheet of solderable metal formed by cutting out and flanging. It will be clear of those having ordinary skill in the art that other embodiments are possible. Several differently formed metal members can be disposed in one housing.

Nor is the invention limited to the embodiments of a connector shown and discussed, but it can in principle be used for any type of connector which need to be secured on a substrate.

What is claimed is:

1. A connector adapted for mounting on a circuit substrate comprising:

a housing of electrically insulating material having a front wall and a rear wall, a top wall and a bottom wall, two side walls and a plurality of parallel, partition walls disposed vertically between said two side walls and defining a plurality of parallel channels between said two side walls, said connector being mounted on the circuit substrate along at least a portion of said bottom wall, a plurality of contact elements of electrically conducting material disposed in said channels of the housing, each of said contact elements having a contact end for electrically mating with another connector and a connecting end for electrically connecting the contact element to said substrate, and means for securing the connector to the substrate including at least one flat member formed of solderable metal, said flat metal member disposed vertically within in at least one of said partition walls of the housing, said metal member being approximately T-shaped with a top horizontal portion and a substantially pin-shaped, vertical portion extending at a right angle from the top horizontal portion, said top portion extending also horizontally within at least a lower portion of said one partition wall toward said rear wall, said top portion provided with a lip along a lower edge thereof for engaging an interior surface of the bottom wall of the housing, said vertical portion projecting perpendicularly from the bottom wall of the housing to engage a corresponding aperture in said circuit substrate wherein it is soldered for securely mounting the connector to said substrate, said flat metal member being of a thickness less than said one partition wall and said one partition wall being of the same thickness as the other partition walls, thereby providing equal spacing between said contact elements irrespective of said metal member.

2. A connector according to claim 1 wherein said side walls have a thickness equal to one-half or less of the thickness of said partition walls, thus enabling said connector to be stackably mounted on said circuit substrate adjacent similar connectors along said side walls with all adjacent contact elements being shaped equally from one another and without loss of any position for one or more of said contact elements.

* * * * *